US005431573A

United States Patent [19]

Endo et al.

[11] Patent Number: 5,431,573

[45] Date of Patent: Jul. 11, 1995

[54] CONNECTOR USABLE WITH A LOW INTENSITY OF INSERT POWER

[75] Inventors: Takayoshi Endo; Hitoshi Saito; Hitoshi Sakai; Minoru Imamura, all of Shizuoka, Japan

[73] Assignee: Yazaki Corporation, Tokyo, Japan

[21] Appl. No.: 141,643

[22] Filed: Oct. 27, 1993

[30] Foreign Application Priority Data

Oct. 28, 1992 [JP] Japan ..... 4-289975

[51] Int. Cl.[6] ..... H01R 13/62

[52] U.S. Cl. ..... 439/157; 439/410; 439/341

[58] Field of Search ..... 439/288, 289, 374, 376, 439/347, 540, 248, 341, 350, 351, 372, 246, 247, 152–160

[56] References Cited

U.S. PATENT DOCUMENTS

| | | | |
|---|---|---|---|
| 2,369,860 | 2/1945 | Schroeder | 439/341 |
| 4,586,766 | 5/1986 | Hofmeister | 339/45 M |
| 4,602,351 | 7/1986 | Shimamura et al. | 439/248 |
| 4,952,176 | 8/1990 | Koiner et al. | 439/376 |
| 5,114,360 | 5/1992 | Steinhardt et al. | 439/341 |

FOREIGN PATENT DOCUMENTS 61-166483 10/1986 Japan .

*Primary Examiner*—David L. Pirlot
*Attorney, Agent, or Firm*—Sughrue, Mion, Zinn, Macpeak & Seas

[57] ABSTRACT

A connector composed of a connector assembly A1 including a plurality of one connectors $A_1$, $A_2$, $A_3$ and $A_4$, a connector group B1 including a plurality of other connectors $B_1$, $B_2$, $B_3$ and $B_4$ to be electrically connected to the one connectors $A_1$, $A_2$, $A_3$ and $A_4$, and a connector assembly frame C1 having a plurality of connector driving elongated holes *6a, 6b, 6c* and *6d* formed thereon corresponding to the other connectors $B_1$, $B_2$, $B_3$ and $B_4$. While driven pins 5 disposed on the other connectors $B_1$, $B_2$, $B_3$ and $B_4$ are fitted into the connector driving elongated holes *6a, 6b, 6c* and *6d*, the other connectors $B_1$, $B_2$, $B_3$ and $B_4$ are individually turnably received in the connector assembly frame C1. Subsequently, while one end of the connector assembly frame C1 is turnably engaged with a fulcrum portion 2 formed at one end of a base plate having the one connectors $A_1$, $A_2$, $A_3$ and $A_4$ mounted thereon, the connector assembly frame C1 is manually turned about the fulcrum portion 2 so as to allow the other connectors $B_1$, $B_2$, $B_3$ and $B_4$ to be successively turnably fitted to the one connector $A_1$, $A_2$, $A_3$ and $A_4$ arranged on the base board 1.

5 Claims, 13 Drawing Sheets

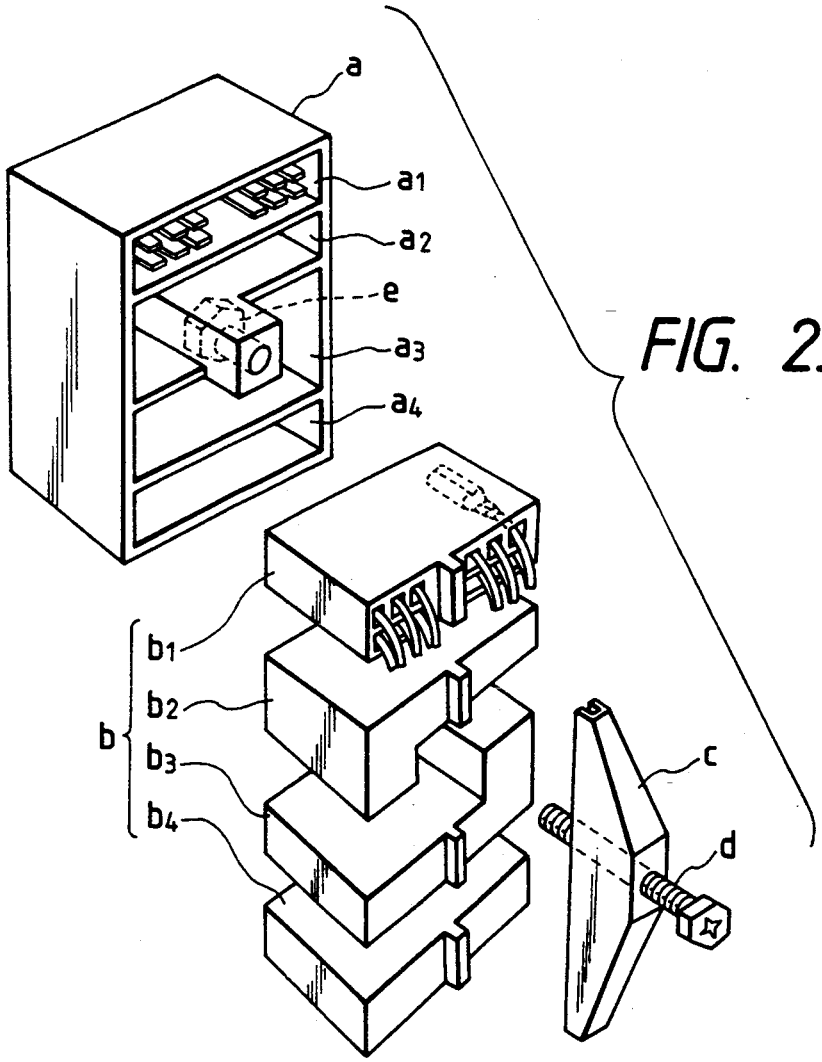
FIG. 25
FIG. 26
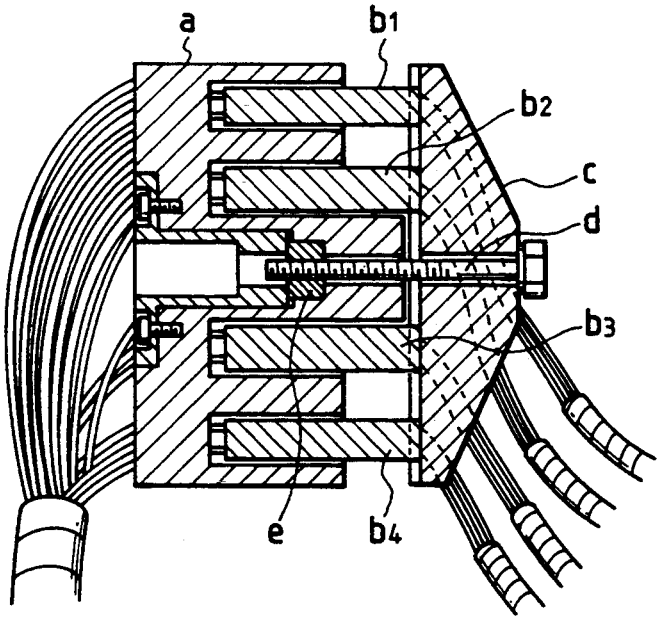

CONNECTOR USABLE WITH A LOW INTENSITY OF INSERT POWER

BACKGROUND OF THE INVENTION

The present invention relates to a connector usable for a wire harness or the like for an automobile with a low intensity of insert power wherein a plurality of connectors are successively fitted to a plurality of opponent connectors by actuating a driving member.

To facilitate understanding of the present invention, a typical convectional connector of the foregoing type will be described below with reference to FIG. 25 and FIG. 26.

In FIG. 25, reference character a designates a female connector assembly which includes a plurality of connector fitting chamber $a_1$, $a_2$, $a_3$ and $a_4$. Reference character b designates a male connector group which is composed of a plurality of male connectors $b_1$, $b_2$, $b_3$ and $b_4$ corresponding to the connector fitting chambers $a_1$, $a_2$, $a_3$ and $a_4$. Reference character c designates a connection holding member. A tightening bolt d is threadably fitted through a female-threaded hole formed at the central part of the connection holding member c, and a tightening nut e is fixedly secured to the female connector assembly a at the central part of the latter.

When fitting is achieved, the tightening bolt d is threadably fitted into the tightening nut e while the connecting holding member c is brought in contact with the rear surface of the respective male connectors $b_1$, $b_2$, $b_3$ and $b_4$ so that as the tightening bolt d is tightened, these male connectors $b_1$, $b_2$, $b_3$ and $b_4$ are fitted into the opponent fitting chambers $a_1$, $a_2$, $a_3$ and $a_4$ to build an integral structure (see FIG. 26).

In the shown case, since a bolt and a nut are used as components for the purpose of achieving connection between a male connector and an opponent female connector, each connecting operation is performed at an increased cost. Another problem is that a torque wrench or the like is required at the time of each connecting operation.

SUMMARY OF THE INVENTION

The present invention has been made in consideration of the aforementioned background and its object resides in providing a connector usable with a low intensity of insert power wherein a plurality of connectors are successively turnably fitted to a plurality of opponent connectors by actuating a driving member.

According to a first aspect of the present invention, there is provided a connector usable with a low intensity of insert power, wherein the connector is characterized in that the connector includes a plurality of one connectors arranged on a base board, a connector group including a plurality of other connectors, and a connector assembly frame having a plurality of connectors driving elongated holes formed thereon corresponding to the other connectors, that while the driven pins disposed on the other connectors are engaged with the connector driving elongated holes, the other connector are individually turnably received in the connector assembly frame, and that as the connector assembly frame is manually turned about a fulcrum portion formed at one end thereof, the other connectors are successively turnably fitted to the one connectors.

In addition, according to a second aspect of the present invention, there is provided a connector usable with a low intensity of insert power, wherein the connector is characterized in that each of the connector driving elongated holes includes a relief hole portion as an extension therefrom with a transition point located at the intermediate position thereof, and that when the other connectors are substantially completely fitted to the one conductors, the driving pins are located at the transition points.

Additionally, according to a third aspect of the present invention, there is provided a connector usable with a low intensity of insert power, wherein the connector is characterized in that provisional engagement protuberances are disposed on each other connector and provisional fixing ribs are formed on the opposite inner side walls of the connector assembly frame corresponding to the provisional engagement protuberances so as to allow the provisional fixing ribs to maintain the attitude of each other connector via the provisional engagement protuberances, and that when the other connectors are fitted to the opponent one connectors, the provisional engagement protuberances climb over the provisional fixing ribs.

Further, according to a fourth aspect of the present invention, there is provided a connector usable with a low intensity of insert power, wherein the connector is characterized in that a plurality of vibration preventive holes are formed on the connector assembly frame and vibration preventive protuberances adapted to be received in the vibration preventive holes are disposed on each other connector, and that a plurality of fitting guide projections are arranged on the opposite sides of the one connectors so as to cooperate with the other connectors.

As the connector assembly frame is manually turned about a fulcrum portion formed at one end thereof, a plurality of other connectors on the connector group are successively turnably fitted to a plurality of one connectors arranged on the base board via engagement of the driven pins disposed on each other connector with the corresponding connector driving elongated holes.

When plural opposing pairs of connectors are substantially turnably fitted to each other, the driven pins are located at the transition points, and subsequently, as the connector assembly frame is turned further, the driven pins are displaced to reach the relief hole portions.

Since the provisional fixing ribs serve to maintain a predetermined inclined attitude thereof in the connector assembly frame in cooperation of the provisional fixing ribs with the provisional engagement protuberances, this prevents the other connectors from being oriented in the downward direction.

The vibration preventive holes restrict the turned state of the other connectors relative to the connector assembly frame within a predetermined range in cooperation with the vibration preventive protuberances, and moreover, the fitting guide projections correct the fitted attitude of the other connectors.

BRIEF DESCRIPTION OF THE DRAWINGS

FIG. 25 is a perspective view of a conventional connector, particularly showing essential components constituting the connector in the disassembled state.

FIG. 26 is a sectional view of the conventional connector shown in FIG. 25, particularly showing that the essential components are fitted to each other in the connector.

DETAILED DESCRIPTION OF THE PREFERRED EMBODIMENTS

The present invention will be described in detail hereinafter with reference to the accompanying drawings which illustrate preferred embodiments thereof.

Figure 1:
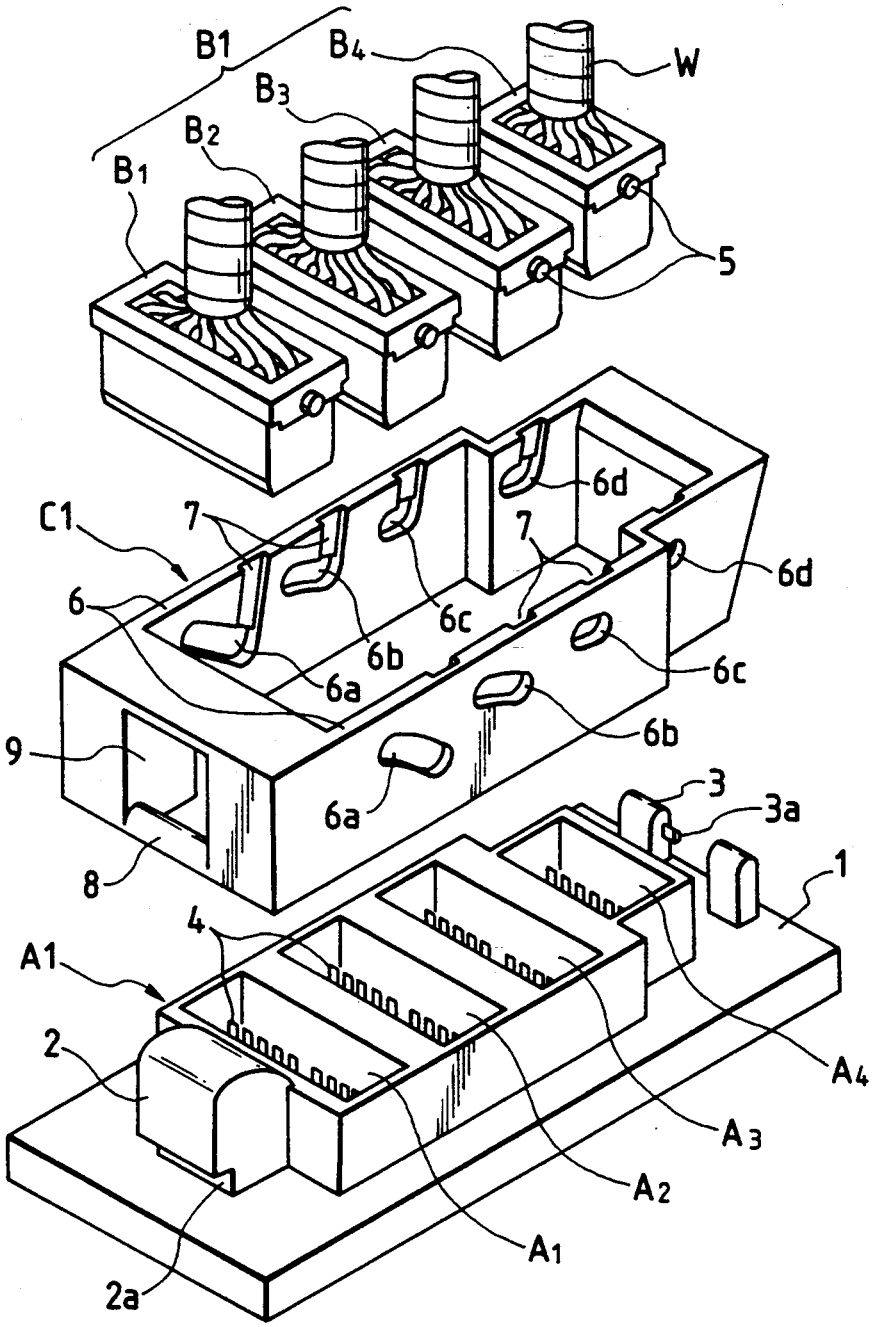
FIG. 1 is a perspective view of a connector usable with a low intensity of insert power according to a first embodiment of the present invention.

A connector of the foregoing type constructed according to a first embodiment of the present invention will be described below with reference to FIG. 1 to FIG. 5. In FIG. 1, reference character A1 designates a female connector assembly. A plurality of female connectors $A_1$, $A_2$, $A_3$ and $A_4$ are arranged one after another on a base board 1 of the female connector assembly A1, and a turning movement fulcrum portion 2 having an engagement recess 2*a* formed therein is disposed at one end of the base board 1, i.e., at the left-hand end of the same as seen in the longitudinal direction, while two engagement portions 3 each including an engagement protuberance 3*a* are disposed on the other end of the base board 1, i.e., at the right-hand end of the same as seen in the longitudinal direction. A plurality of male terminals 4 are received in each of the female connectors $A_1$, $A_2$, $A_3$ and $A_4$.

Reference character B1 designates a male connector group consisting of a plurality of male connectors $B_1$, $B_2$, $B_3$ and $B_4$. Driven pins 5 are horizontally projected outside of the opposite side walls of the male connectors $B_1$, $B_2$, $B_3$ and $B_4$. A plurality of female terminals (not shown) to be electrically connected to the male terminals 4 are disposed in each of the respective male connectors $B_1$, $B_2$, $B_3$ and $B_4$, and a cable W electrically connected to the female terminals extends from the each of the male connectors $B_1$, $B_2$, $B_3$ and $B_4$ in the upward direction.

Reference character C1 designates a connector assembly frame. A plurality of connector driving elongated holes 6*a*, 6*b*, 6*c* and 6*d* are formed through the opposite side walls 6 each extending in the longitudinal direction in such a manner that a length of each connector driving elongated hole is stepwise reduced in accordance of the order of the elongates holes 6*a*, 6*b*, 6*c* and 6*d* and an inclination angle of the same relative to the horizontal direction stepwise varies in accordance with the same order as mentioned above. In addition, a plurality of pin guide grooves 7 are formed on the inner wall surfaces of the opposite side walls 6 in such a manner that they extend from the rear ends of the pin guide grooves 7 to reach the connector driving elongated holes 6*a*, 6*b*, 6*c* and 6*b* to reach the latter while the depth of each pin guide hole 7 is increasingly reduced as it approaches the connector driving elongated holes 6*a*, 6*b*, 6*c* and 6*d*. It should be noted that each of the connector driving elongated holes 6*a*, 6*b*, 6*c* and 6*d* may be designed in the form of a groove.

Figure 2:
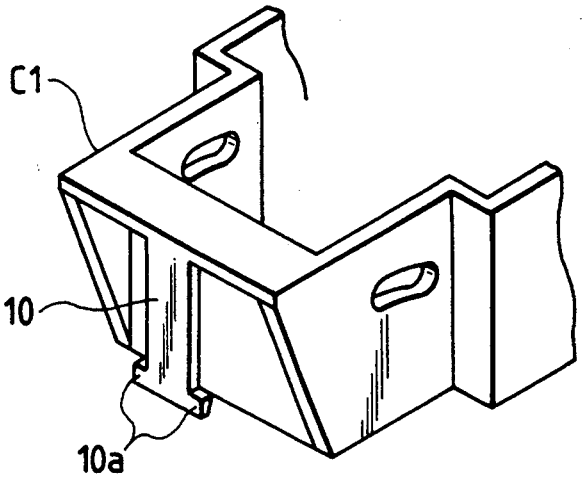
FIG. 2 is a fragmentary perspective view of the connector shown in FIG. 1, particularly showing the structure of a connector assemble frame.

A turning movement support shaft 8 adapted to be engaged with the engagement recess 2*a* of the turning movement fulcrum portion 2 is formed in a cutout portion 9 at one end of the connector assembly frame C1, i.e., at the left-hand end of the latter, while a flexible engagement piece 10 including engagement protuberances 10*a* to be engaged with the engagement protuberances 3*a* of the engagement portions 3 is arranged at the other end of the connector assembly frame C1, i.e., at the right-hand end of the latter (see FIG. 2).

Figure 3:
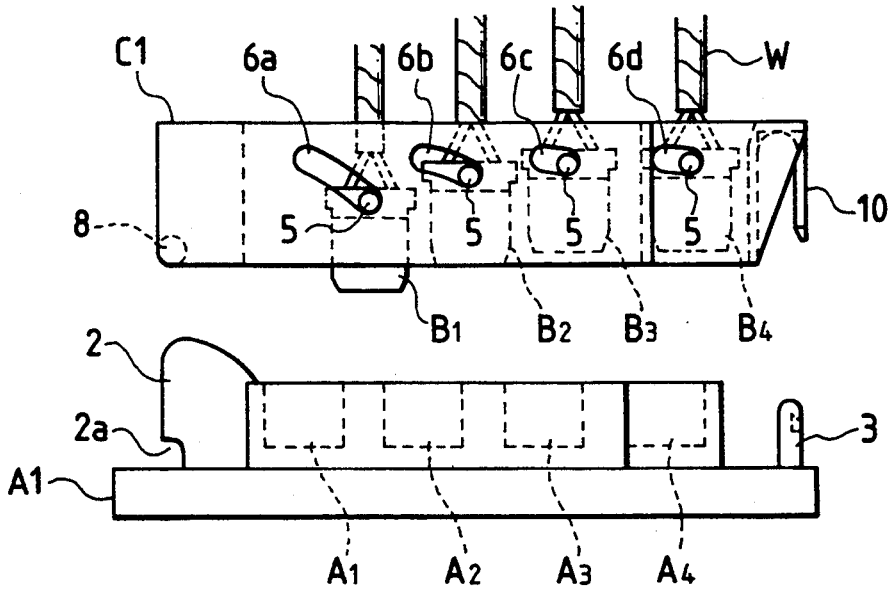
FIG. 3 is a side view of the connector shown in FIG. 1, particularly showing that a plurality of male connectors are received in the connector assembly frame.
Figure 4:
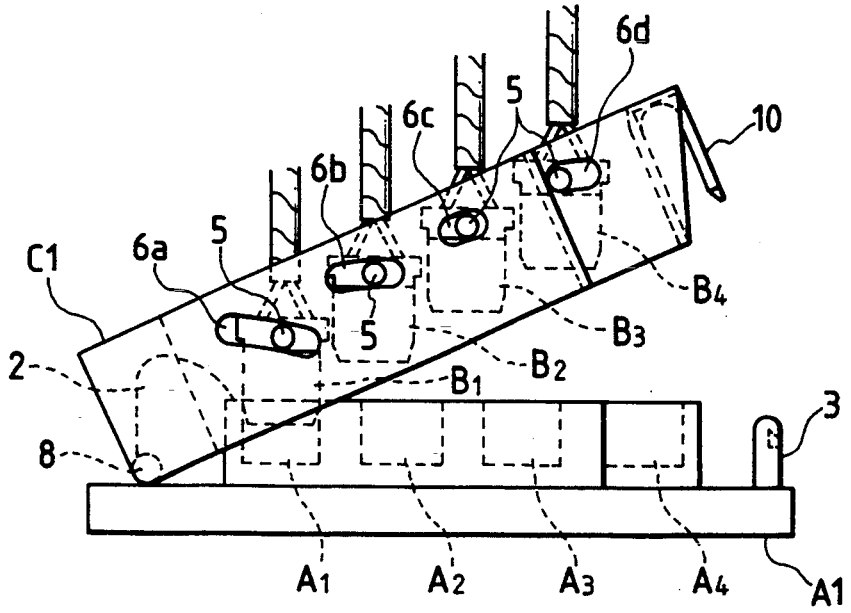
FIG. 4 is a side view of the connector shown in FIG. 1, particularly showing that the connector assembly frame is held at the initial time of a fitting operation.
Figure 5:
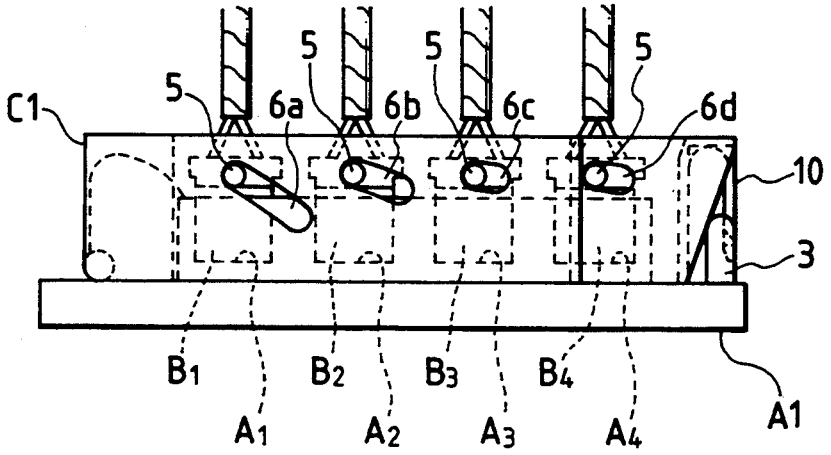
FIG. 5 is a side view of the connector shown in FIG. 1, particularly showing that the male connectors are completely fitted into a plurality of female connectors.
Figure 6:
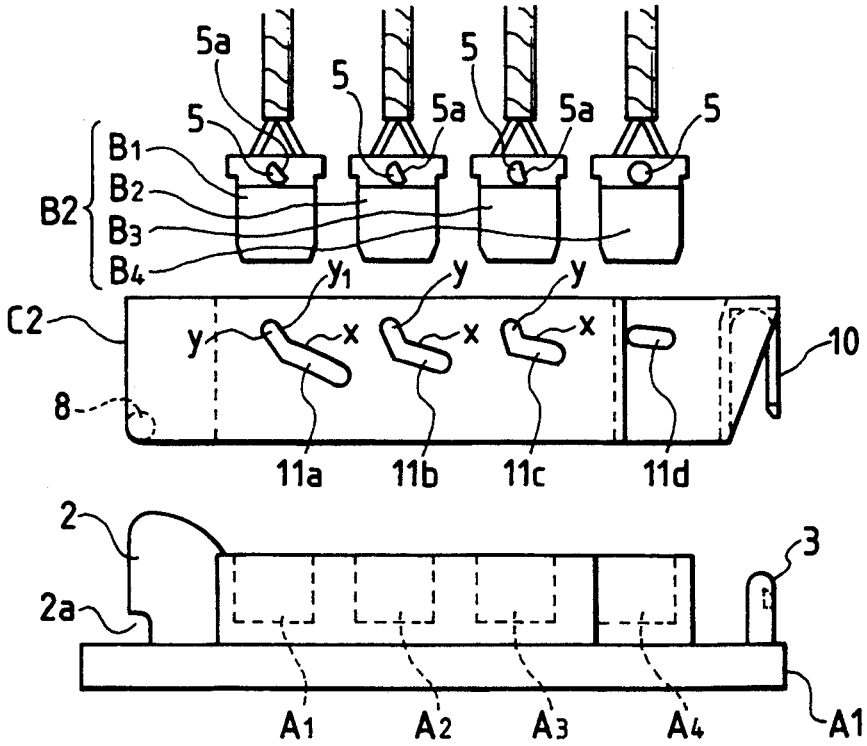
FIG. 6 is a side view of a connector usable with a low intensity of insert power according to a second embodiment of the present invention, particularly showing essential components constituting the connector in the disassembled state.

With such construction, the male connectors $B_1$, $B_2$, $B_3$ and $B_4$ are turnably received in the connector frame assembly C1 by press-fitting driving pins 5 into the connector driving elongated holes 6*a*, 6*b*, 6*c* and 6*d* via the pin guide grooves 7 (see FIG. 3). While the foregoing state is maintained, the connector frame assembly C1 is first inclined so as to allow the turning movement support shaft 8 to be engaged with the engagement recess 2*a* of the turning movement fulcrum portion 2 of the female connector A1, and subsequently, the other side of the connector frame assembly C1 is turned in the arrow-marked direction shown in FIG. 4. At this time, the driving pins 5 are fitted into the connector driving elongated holes 6*a*, 6*b*, 6*c* and 6*d* in accordance with such an order that firstly, the male connector $B_1$ is fitted into the female connector $A_1$, secondly, the male connector $B_2$ is fitted into the female connector $A_2$, thirdly, the male connector $B_3$ is fitted into the female connector $A_3$, and finally, the male connector $B_4$ is fitted into the female connector $A_4$. While the foregoing state is maintained, the flexible engagement piece 10 is engaged with the engagement portions 3 on the base board 1, whereby the female connector assembly A1, the male connector group B1 and the connector frame assembly C1 are locked together in the completely connected state (see FIG. 5). In other words, as the connector frame assembly C1 is turned, the driven pins 5 on the male connectors $B_1$, $B_2$, $B_3$ and $B_4$ are caused to successively move in the connector driving elongated holes 6*a*, 6*b*, 6*c* and 6*d*.

Next, a connector of the foregoing type constructed according to a second embodiment of the present invention will be described below with reference to FIG. 6 to FIG. 12. Same components as those in the first embodiment are represented by same reference numerals. A connector assembly frame C2 includes a plurality of connector driving elongated holes 11*a*, 11*b*, 11*c* and 11*b* on the opposite side walls thereof. Each of the connector driving elongated holes 11*a*, 11*b* and 11*c* located on the turning movement support shaft 8 side exhibits a flattened L-shaped contour of which intermediate part is represented by a transition point x, and a part of each elongated hole above the transition point x serves as a relief hole portion y of which contour is represented by a curve $y_1$ which is contoured to be substantially coincident with the locus of turning movement of the connector assembly frame C2. A cutout surface 5*a* is formed on each of driven pins 5 on male connectors $B_1$, $B_2$ and $B_3$ in a male connector group B2 corresponding to the curve $y_1$ of the relief hole portion y (see FIG. 6 and FIG. 12).

Figure 7:
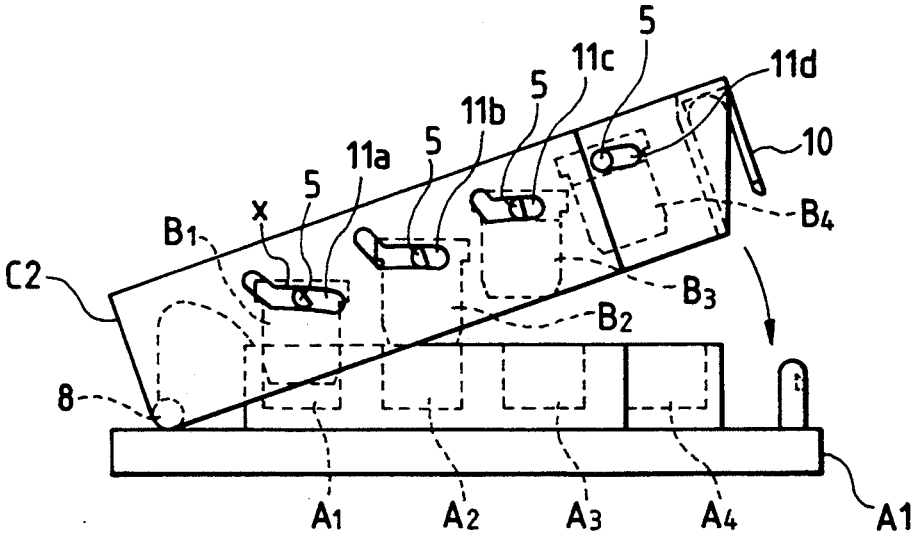
FIG. 7 is a side view of the connector shown in FIG. 6, particularly showing that a connector assemble frame is held in the initial state of a fitting operation of the connector shown in FIG. 6.
Figure 8:
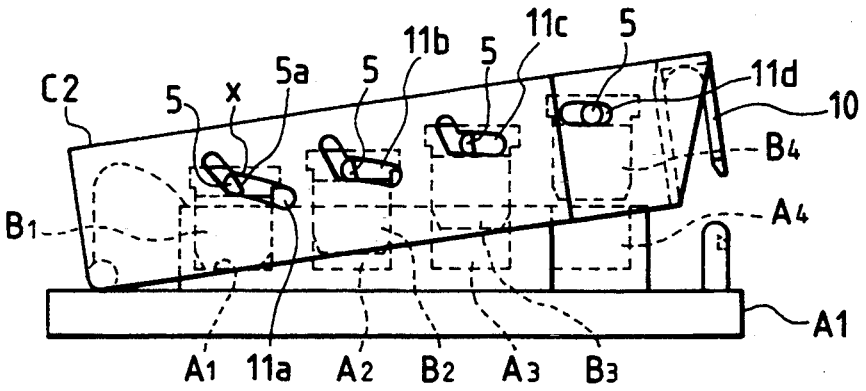
FIG. 8 is a side view of the connector shown in FIG. 6, particularly showing that the connector assembly frame is held in the intermediate state during the fitting operation.
Figure 9:
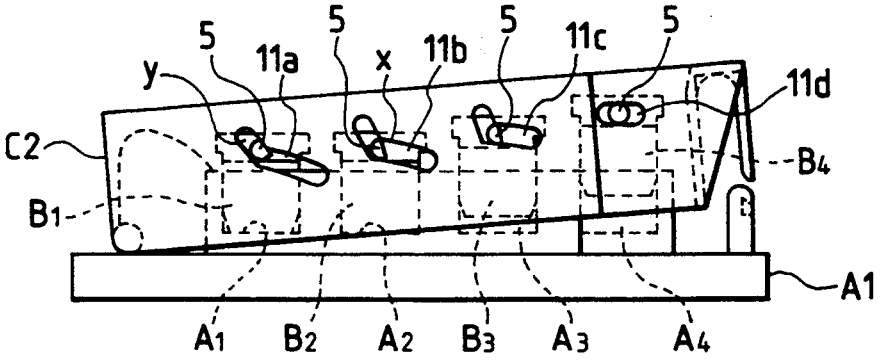
FIG. 9 is a side view of the connector shown in FIG. 6, particularly showing that the connector assembly frame is held at the substantially last stage of the fitting operation.
Figure 10:
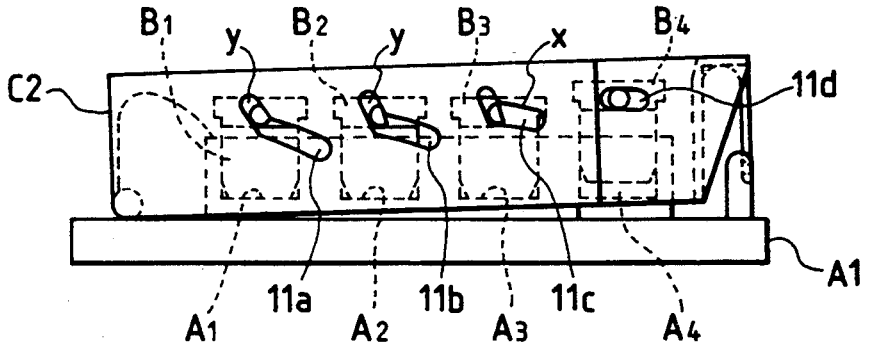
FIG. 10 is a side view of the connector shown in FIG. 6, particularly showing that the connector assembly frame is substantially fully fitted to a connector assembly.
Figure 11:
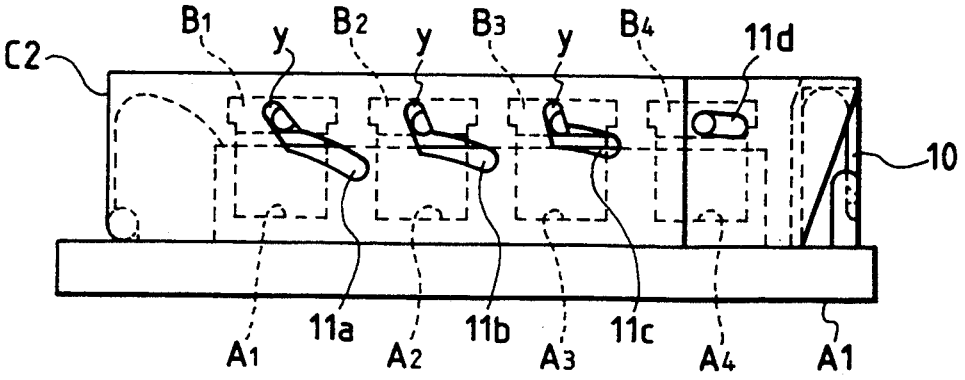
FIG. 11 is a side view of the connector shown in FIG. 6, particularly showing that the connector assembly frame is fully fitted to the connector assembly.
Figure 12:
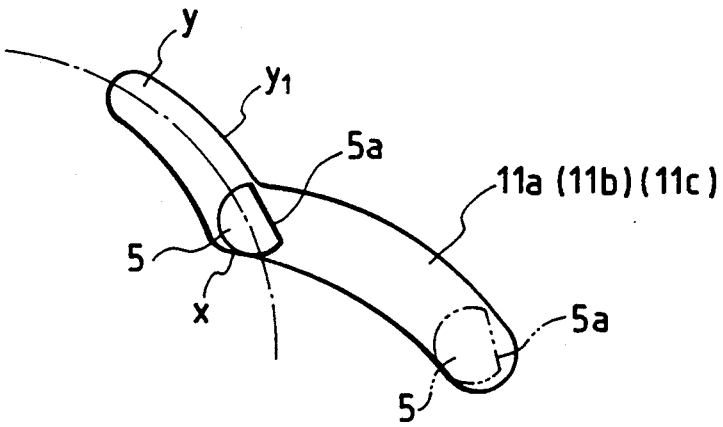
FIG. 12 is a fragmentary side view of the connector shown in FIG. 6, particularly showing the essential components of the connector are completely fitted to each other.
Figure 13:
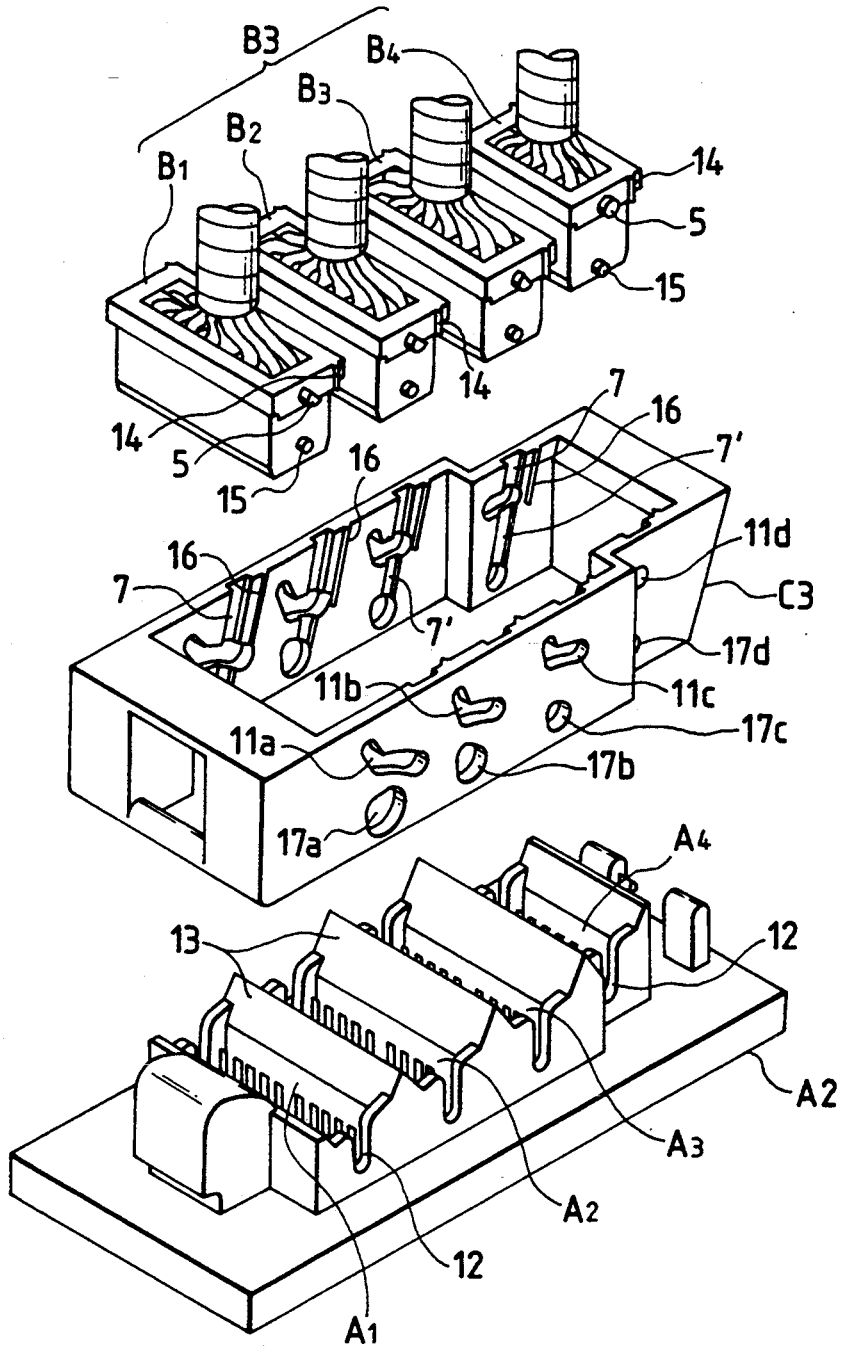
FIG. 13 is a perspective view of a connector usable with a low magnitude of insert power according to a third embodiment of the present invention, particularly showing essential components constituting the connector in the disassembled state.

With such construction, when the connector assembly frame C2 is turnably depressed to turn about the turning movement support shaft 8 while the driven pins 5 are fitted into the connector driving elongated holes 11*a*, 11*b*, 11*c* and 11*d* with the male connectors $B_1$, $B_2$, $B_3$ and $B_4$ depressed thereby, firstly, the male connector $B_1$ starts to be fitted into the female connector $A_1$ (see FIG. 7). As the connector frame assembly $C_2$ is turned further, the male connectors $B_2$ and $B_3$ are fitted into the female connectors $A_2$ and $A_3$, and at the same time, the male connector $B_1$ is completely fitted into the female connector $A_1$ and the driven pin 5 reaches the bending transition x (see FIG. 8). Thereafter, as the connector assembly frame C2 is turned, the driven pin 5 is displaced in the relief hole portion y without any resistance, resulting in the load to be borne by the driven pin 5 to be reduced. Subsequently, after the male connector $B_2$ is completely fitted into the female connector $A_2$, the driven pin 5 reaches the transition point x (see FIG. 9). In addition, when the male connector $B_3$ is completely fitted into the female connector $A_3$, the driven pin 5 reaches the transition point x (see FIG. 10). Thus, there does not arise a malfunction that the load to be borne by each driven pin 5 at the time of fitting increases.

Next, a connector of the foregoing type constructed according to a third embodiment of the present invention will be described below with reference to FIG. 13 to FIG. 20. Same components as those in the preceding embodiment are represented by same reference numerals. A female connector assembly A2 includes a plurality of female connectors $A_1$, $A_2$, $A_3$ and $A_4$ of which opposite side walls have a plurality of relief slits 12 formed therein. In addition, a triangle-shaped fitting guide projection 13 is arranged between adjacent female connectors, i.e., between female connectors $A_1$ and $A_2$, between female connector $A_2$ and $A_3$ and between female connectors $A_3$ and $A_4$.

With respect to a plurality of male connectors $B_1$, $B_2$, $B_3$ and $B_4$ in a male connector group B3, provisional engagement protuberances 14 are disposed sideward of driven pins 5, and moreover, vibration preventive protuberances 15 are disposed ahead of the driven pins 5 (i.e., below the driven pins 5 in the drawing).

With respect to a connector assembly frame C3, a provisional fixing rib 16 adapted to be engaged with the provisional engagement protuberance 14 is disposed sideward of each of connector driving elongated holes 11*a*, 11*b*, 11*c* and 11*d*, and vibration preventive holes 17*a*, 17*b*, 17*c* and 17*d* are formed ahead of the connector driving elongated holes 17*a*, 17*b*, 17*c* and 17*d* (i.e., downward of the connector driving elongated holes 17*a*, 17*b*, 17*c* and 17*d*). In addition to pin guide grooves 7, another pin guide grooves 7' extending downward from connector driving elongated holes 6*a*, 6*b*, 6*c* and 6*d* to the vibration preventive holes 17*a*, 17*b*, 17*c* and 17*d* are formed on the inner walls of the opposite side walls 6 of the connector assembly frame C3.

Figure 14:
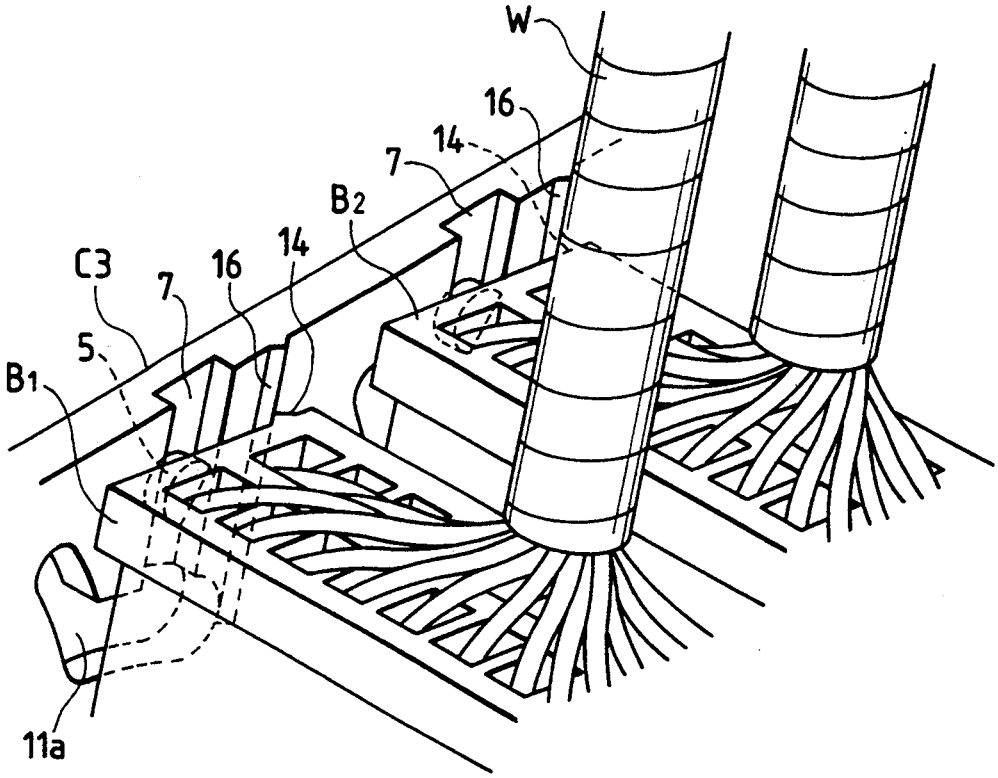
FIG. 14 is a fragmentary enlarged perspective view of the connector shown in FIG. 13, particularly showing that a plurality of male connectors are provisionally received in a connector assembly frame.
Figure 15:
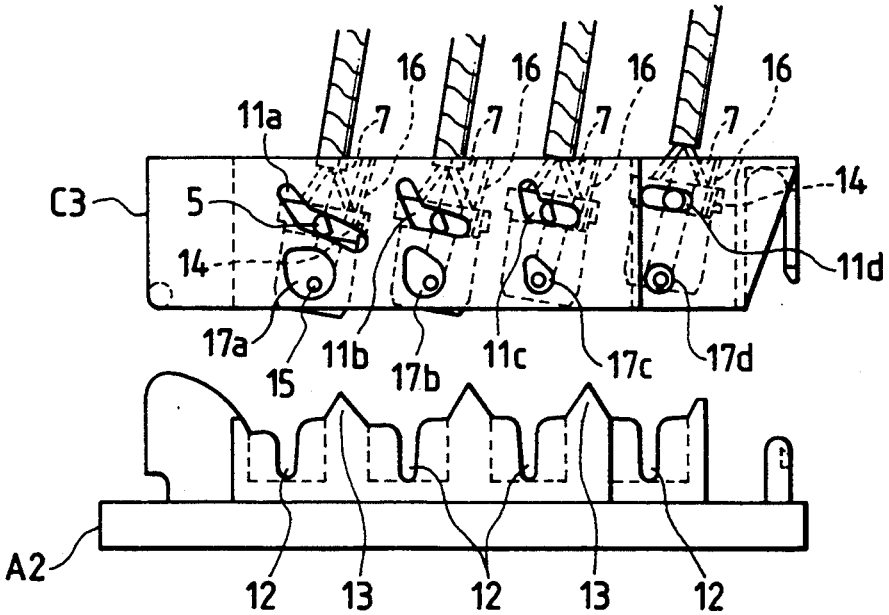
FIG. 15 is a side view of the connector shown in FIG. 13, particularly showing that the male connector are received in the connector assembly frame.

With this construction, while the vibration preventive protuberances 15 are received in the vibration preventive holes 17*a*, 17*b*, 17*c* and 17*d* via the pin guide grooves 7 and 7', the driven pins 5 are fitted into the connector driving elongated holes 11*a*, 11*b*, 11*c* and 11*d*, and the male connectors $B_1$, $B_2$, $B_3$ and $B_4$ are received in the connector assembly frame C3, the provisional engagement protuberances 14 are engaged with the provisional fixing ribs 16 at the positions located outside of the latter (see FIG. 14). Thus, the respective male connectors $B_1$, $B_2$, $B_3$ and $B_4$ are held with a predetermined inclined attitude without any lowering thereof in the connector assembly frame C3. While the foregoing state is maintained, the displacement of the male connectors $B_1$, $B_2$, $B_3$ and $B_4$ to the fitting operation start positions for the respective female connectors $A_1$, $A_2$, $A_3$ and $A_4$ is properly guided with the aid of the provisional fixing ribs 6 (see FIG. 15, FIG. 16 and FIG. 17).

Figure 16:
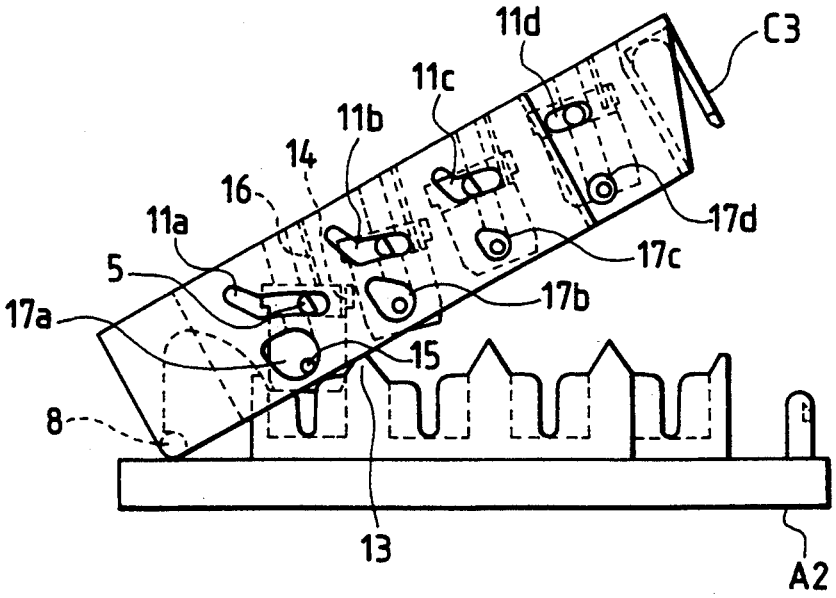
FIG. 16 is a side view of the connector shown in FIG. 13, particularly showing that a connector assembly frame is held in the initial state of a fitting operation of the connector shown in FIG. 13.
Figure 17:
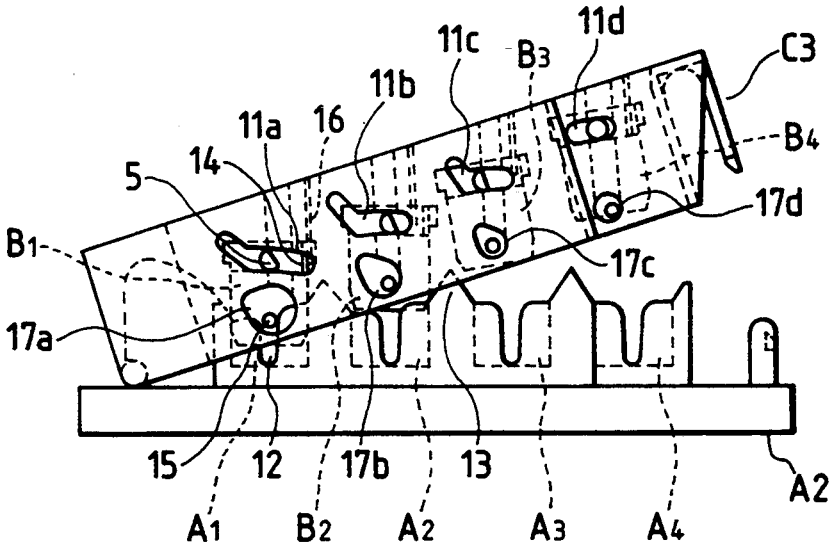
FIG. 17 is a side view of the connector shown in FIG. 13, particularly showing that the connector assembly frame is held in the intermediate state during the fitting operation.
Figure 18:
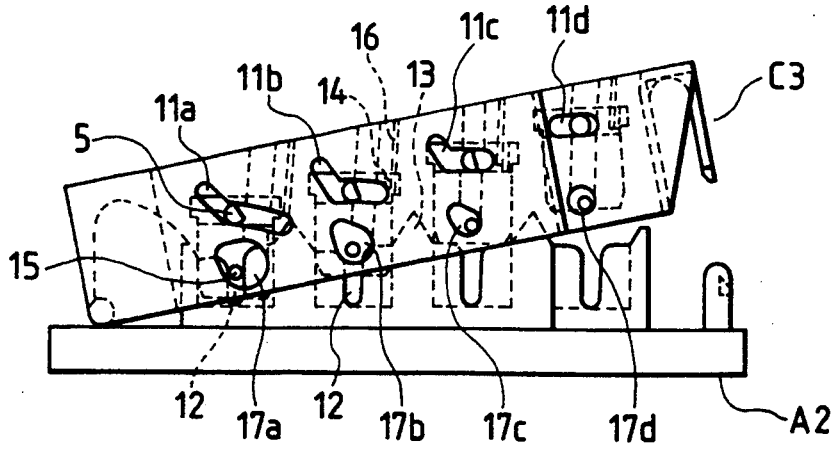
FIG. 18 is a side view of the connector shown in FIG. 13, particularly showing that the connector assembly frame is held at the substantially last stage of the fitting operation.
Figure 19:
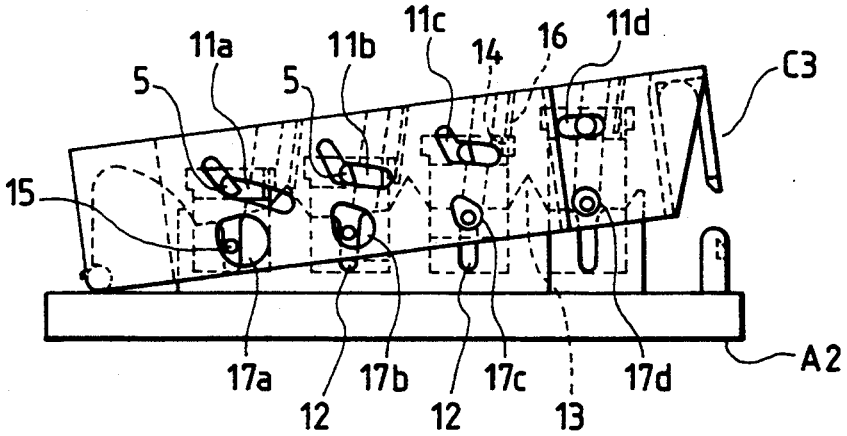
FIG. 19 is a side view of the connector shown in FIG. 13, particularly showing that the connector assembly frame is substantially fully fitted to a connector assembly.
Figure 20:
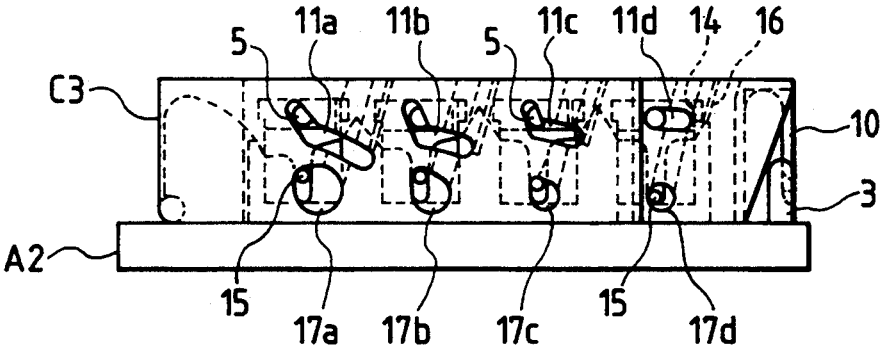
FIG. 20 is a side view of the connector shown in FIG. 13, particularly showing that the connector assembly frame is fully fitted to the connector assembly.
Figure 21:
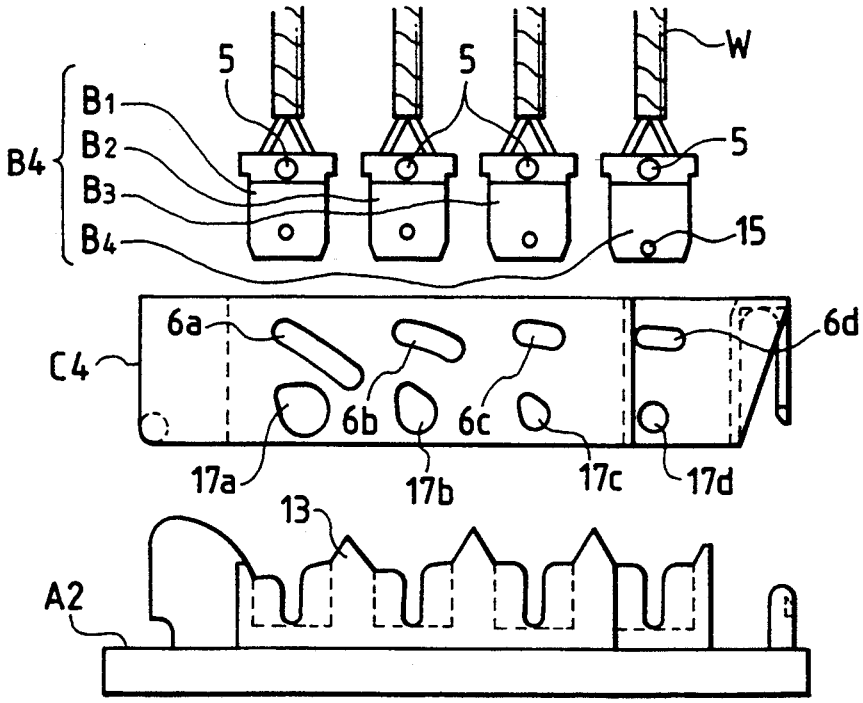
FIG. 21 is a side view of a connector usable with a low intensity of insert power according to a fourth embodiment of the present invention, particularly showing essential components constituting the connector in the disassembled state.
Figure 22:
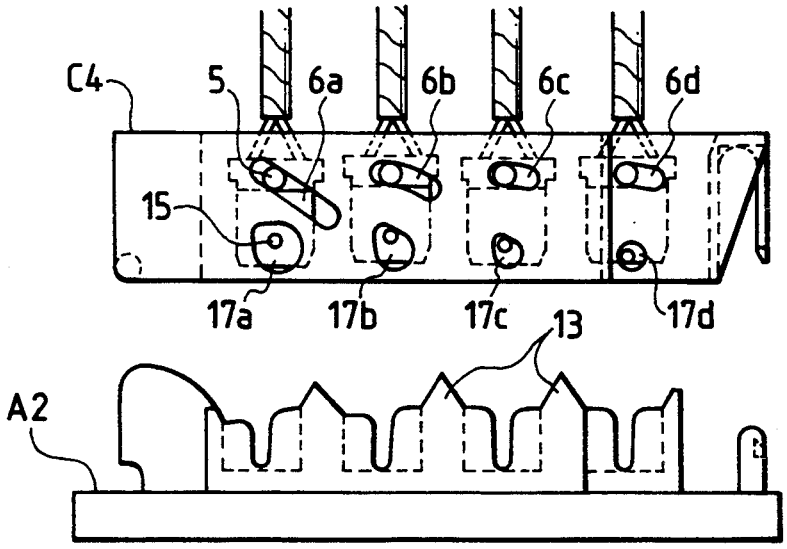
FIG. 22 is a side view of the connector shown in FIG. 21, particularly showing that a plurality of male connectors are received in a connector assembly frame.
Figure 23:
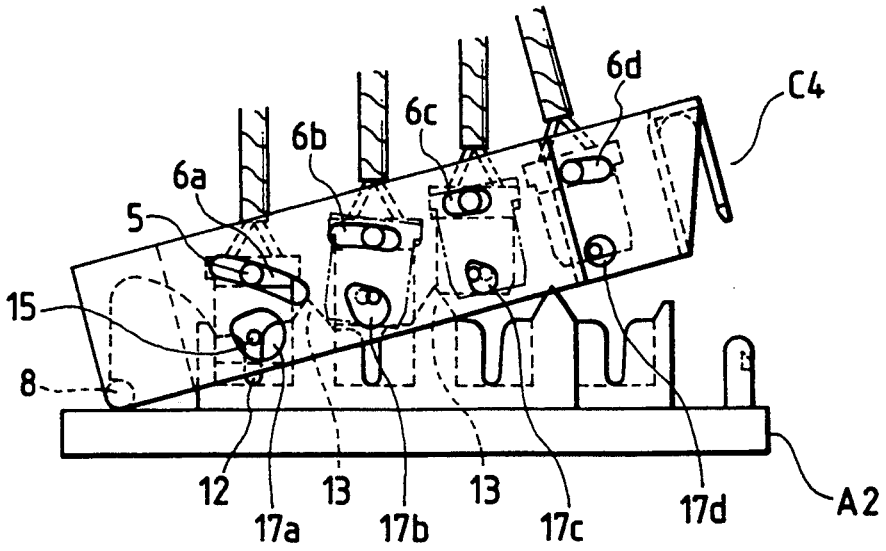
FIG. 23 is a side view of the connector shown in FIG. 21, particularly showing that the connector assembly frame is held in the intermediate state during a fitting operation.
Figure 24:
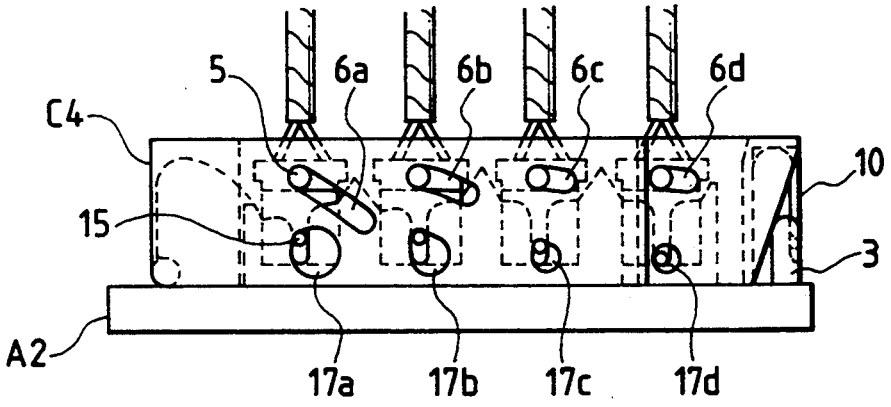
FIG. 24 is a side view of the connector shown in FIG. 21, particularly showing that the connector assembly frame is fully fitted to a connector assembly.

When the connector assembly frame C3 is turnably actuated, as the male connector $B_1$ approaches the female connector $A_1$, the preceding inclined attitude of the male connector $B_1$ is shifted to a vertical attitude by the triangle-shaped fitting guide projection 13 so as to allow the male connector $B_1$ to be correctly fitted into the female connector $A_1$ (see FIG. 16). As the male connector $B_1$ is increasingly fitted into the female connector $A_1$, the provisional engagement protuberances 14 climb over the provisional fixing rib 16 while slightly flexibly deforming the side wall 6 in the outward direction. At this time, the male connector $B_2$ starts to be fitted into the female connector $A_2$ (see FIG. 17). Subsequently, the male connector $B_3$ starts to be fitted into the female connector $A_3$ (see FIG. 18), and moreover, the male connector $B_4$ starts to be fitted into the female connector $A_4$. At this time, the male connector $B_1$ is completely fitted into the female connector $A_1$ (see FIG. 19). When the driven pins 5 of the male connectors $B_1$, $B_2$ and $B_3$ are fully received in the relief hole portions y of the connector driving elongated holes 11*a*, 11*b* and 11*c*, the male connectors $B_1$, $B_2$ and $B_3$ are correctly fitted into the female connectors $A_1$, $A_2$ and $A_3$ (see FIG. 20). As the male connectors $B_1$, $B_2$, $B_3$ and $B_4$ are increasingly fitted into the female connectors $A_1$, $A_2$, $A_3$ and $A_4$, the vibration preventive projections 14 are received in the corresponding female connector relief slits 12.

Next, a connector of the foregoing type constructed according to a fourth embodiment of the invention will be described below with reference to FIG. 21 to FIG. 24. Same components as those in the preceding embodiment are represented by same reference numerals. A plurality of vibration preventive holes 17*a*, 17*b*, 17*c* and 17*d* are formed ahead of a connector driving elongated holes 6*a*, 6*b*, 6*c* and 6*d*, i.e., below the latter on a connector assembly frame C4. Driven pins 5 and vibration preventive projections 15 on a plurality of male connectors $B_1$, $B_2$, $B_3$ and $B_4$ of a male connector group B4 are fitted into the connector driving elongated hole 6*a*, 6*b*, 6*c* and 6*d* and the vibration preventive holes 17*a*, 17*b*, 17*c* and 17*d* so that the male connectors $B_1$, $B_2$, $B_3$ and $B_4$ are operatively connected to the connector assembly frame C4 (see FIG. 22).

Since a wire harness W having a large weight is electrically connected to each of the connectors $B_1$, $B_2$, $B_3$ and $B_4$, there is a tendency that each connector is inclined due to the weight of each wire harness W itself. However, the vibration preventive protuberances 15 engaged with the vibration preventive holes 17*a*, 17*b*, 17*c* and 17*d* serve for allowing each wire harness W to be inclined only within a predetermined angular range. While the foregoing state is maintained, the respective connectors $B_1$, $B_2$, $B_3$ and $B_4$ are electrically connected to the female connector assembly A2.

During turnable actuation of the connector assembly frame C4, as the male connector $B_1$ approaches the female connector $A_1$, the foremost end of the female connector $B_1$ is brought in engagement with the triangle-shaped fitting guide projection 13 so that the inclined attitude of the male connector $B_1$ is shifted to the vertical attitude until of the same the male connector $B_1$ is aligned with the female connector $A_1$. While foregoing state is maintained, the male connector $B_1$ is correctly fitted into the female connector $A_1$ (see FIG. 23). A fitting operation is successively performed for a couple of a male connector $B_2$ with a female connector $A_2$, a couple of a male connector $B_3$ with a female connector $A_3$ and a couple of a male connector $B_4$ with a female connector $A_4$ in the same manner as mentioned above so that the male connectors $B_2$, $B_3$ and $B_4$ are correctly fitted into the female connectors $A_2$, $A_3$ and $A_4$ (see FIG. 24).

As is apparent from the above description, according to the present invention, a connector usable with a low intensity of insert power is composed of a connector assembly including a plurality of one connectors, a connector group including a plurality of other connectors to be fitted to the one connectors of the connector assembly, and a connector assembly frame having a plurality of connector driving elongated holes formed thereon corresponding to the plurality of other connectors. While driven pins disposed on the plurality of other connectors are engaged with the connector driving elongated holes, each of the plurality of other connectors is separately turnable in the connector assembly frame. Since one end of the assembly frame is operatively engaged with a fulcrum portion of the connector assembly so as to allow the connector assembly frame to be turned about the fulcrum portion, the plurality of other connectors are successively turnably fitted to the plurality of one connectors. Thus, a magnitude of fitting load to be borne by a plurality of connectors by single actuation can substantially be reduced.

Each connector driving elongated hole is elongated to form a relief hole portion with a transition point located at the intermediate position thereof so that each driven pin is located at the transition point when each connector is fully fitted to the opponent connector. With this construction, each fitting operation can be achieved without any increase of a magnitude of fitting load to be borne by each connector as a fitting operation is performed.

Provisional engagement protuberances are disposed on other connector, while provisional fixing ribs are disposed on the opposite inner wall surfaces of the connector assembly frame. An attitude of each other connector is properly maintained in cooperation of the provisional fixing rib with the provisional engagement protuberance. When an opposing pair of connectors are fitted to each other, the provisional engagement protuberance climbs over the provisional fixing rib. Thus, each connector can assume an adequate fitting operation start attitude.

In addition, a plurality of vibration preventive holes are formed on the connector assembly frame, a vibration preventive protuberance is disposed on each other connector at the position corresponding to each vibration preventive hole, and a plurality of fitting guide protuberances are arranged on the opposite side walls of the connector assembly frame. Thus, while the plurality of other connectors are maintained within the correctable range, the present attitude of each other connector can be corrected to another one suitably employable for a fitting operation with the aid of the fitting guide protuberances.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

What is claimed is:

1. A connector, comprising:

a plurality of first connectors arranged on a base board;

a connector group including a plurality of second connectors respectively connectable with said plurality of first connectors, said second connectors each including driven pins; and a connector assembly frame having a plurality of connector driving elongated holes formed therein for respectively receiving said driven pins said connector assembly frame including a fulcrum portion formed at one end thereof rotatably disposed with respect to said base board.

wherein when said driven pins are engaged with said connector driving elongated holes, said second connectors are individually rotatably supported in said connector assembly frame, and as said connector assembly frame is rotated about said fulcrum portion said second connectors are successively fitted to said first connectors.

2. A connector usable with a low intensity of insert according to claim 1, wherein two engagement portions each including an engagement protuberance are disposed on an end portion of said base board, and a flexible engagement piece including engagement protuberances to be engaged with said engagement protuberances of said engagement portion is arranged at said other end of said connector assembly frame, in such a manner that said first connectors, said connector group and said connector assembly frame are locked together in a completely connected state.

3. A connector according to claim 1, wherein at least one of said connector driving elongated holes includes a relief hole portion as an extension therefrom with a transition point located at the intermediate position thereof, and when said second connectors are substantially completely fitted to said first connectors, said driven pins are located at said transition points.

4. A connector according to claim 1, wherein provisional engagement protuberances are disposed on each of said second connectors, and provisional fixing ribs are formed on the opposite inner side walls of said connector assembly frame corresponding to said provisional engagement protuberances so as to allow said provisional fixing rib to maintain the angular orientation of each of said second connectors in said connector assembly frame via said provisional engagement protuberances, and when said second connectors are fitted to said first connectors, said provisional engagement protuberances pass over said provisional fixing ribs.

5. A connector according to claim 1, wherein a plurality of vibration preventive holes are formed in said connector assembly frame and vibration preventive protuberances adapted to be received in said vibration preventive holes are disposed on each of said second connectors, and a plurality of fitting guide projections are arranged on the opposite sides of said first connectors so as to cooperate with said second connectors.

* * * * *